US005632611A

United States Patent [19]

Sekiya et al.

[11] Patent Number: 5,632,611

[45] Date of Patent: May 27, 1997

[54] SCROLL TYPE PUMP

[75] Inventors: Mutsuo Sekiya, Tokyo; Katsuyuki Fukuhara, Hyogo, both of Japan

[73] Assignee: Mitsubishi Denki Kabushiki Kaisha, Tokyo, Japan

[21] Appl. No.: 559,643

[22] Filed: Nov. 20, 1995

[30] Foreign Application Priority Data

Jun. 23, 1995 [JP] Japan ..... 7-158030

[51] Int. Cl.[6] ..... F01C 1/04

[52] U.S. Cl. ..... 418/55.2; 418/55.1

[58] Field of Search ..... 418/55.1, 55.2, 418/55.3

[56] References Cited

U.S. PATENT DOCUMENTS 4,781,550 11/1988 Morishita et al. ..... 418/55.2
5,099,658 3/1992 Utter et al. .
5,199,280 4/1993 Riffe et al. ..... 418/55.3
5,314,316 5/1994 Shibamoto et al. ..... 418/55.1
5,336,062 8/1994 Richter .

FOREIGN PATENT DOCUMENTS 62-191685 8/1987 Japan .
64-77779 3/1989 Japan .

*Primary Examiner*—Charles G. Freay
*Attorney, Agent, or Firm*—Sughrue, Mion, Zinn, Macpeak & Seas

[57] ABSTRACT

A scroll type pump which suppresses the rocking of the follower scroll member thereof and can perform the stabilized rotation operation thereof is provided with a first bearing mounting part and a second bearing mounting part so as to locate the center of gravitation between them, and supports a first bearing and a second bearing by a supporting part constructed in a body together with a casing by putting the first bearing in the first bearing mounting part and the second bearing in the second bearing mounting part respectively.

8 Claims, 6 Drawing Sheets

FIG. 3 (a)
0° 360°
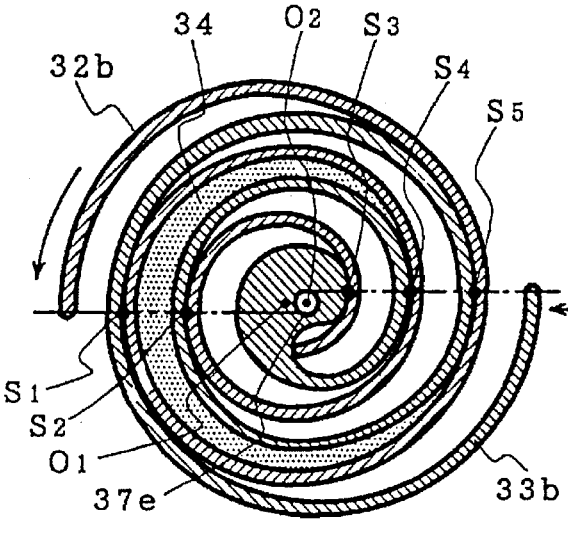
FIG. 3 (d)
270°
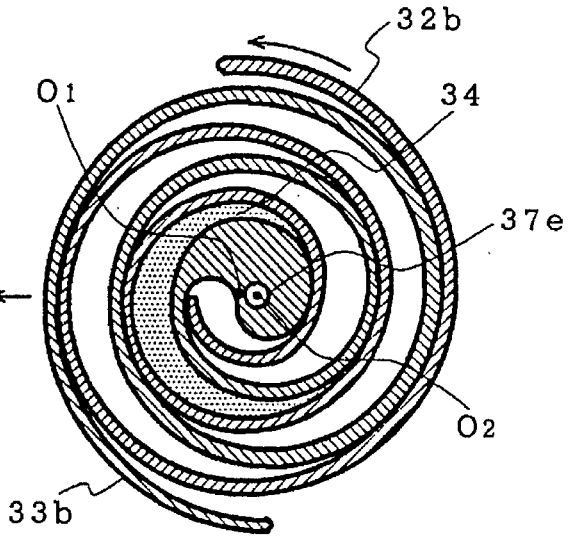
90°
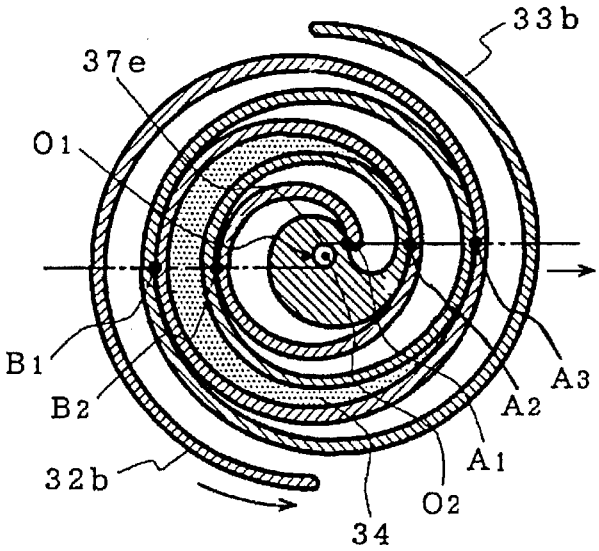
180°
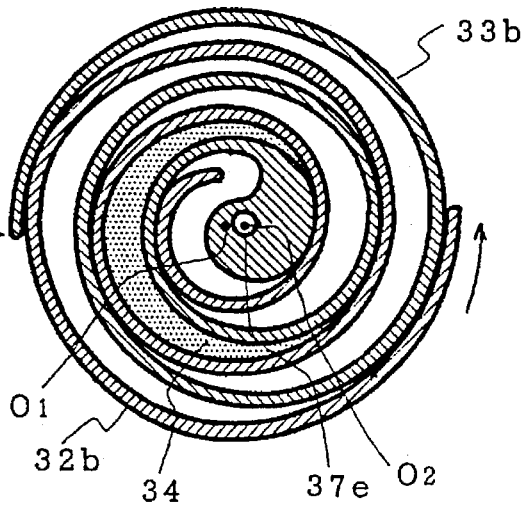
FIG. 3 (b) FIG. 3 (c)

SCROLL TYPE PUMP

BACKGROUND OF THE INVENTION

1. Field of the Invention

This invention relates to a scroll type pump to be utilized for, for example, compressors for freezing or air conditioning, pumps or blowers for industry, or the like.

2. Description of the Prior Art

FIG. 5 is a cross sectional view showing a conventional co-rotational scroll type pump disclosed in, for example Japanese Published Unexamined Patent Application (JP-A) No. 191685/87 (Tokkai-sho 62-191685). FIG. 6(*a*)–FIG. 6(*d*) are sectional views showing the operation of the principal part of the compressor.

In FIG. 5, reference numeral 1 denotes a driving scroll member composed of a disc 1*a* provided with a fluid compressing wall 1*b* formed in a spiral shape as shown in FIG. 6(*a*)–FIG. 6(*d*) on the one side surface 2*aa* of the disc l*a*. Reference numeral 2 denotes a follower scroll member composed of a disc 2*a* provided with a fluid compressing wall 2*b* formed in a spiral shape as shown in FIG. 6(*a*)–FIG. 6(*d*) on the one side surface 2*aa* of the disc 2*a* for being driven to rotate by the driving scroll member 1. Reference numeral 2*c* denotes the center of gravity of the follower scroll member 2.

Reference numeral 3 denotes a fluid compressing chamber shaped generally to a crescent with the fluid compressing walls 1*b* and 2*b* as shown in FIG. 6(*a*)–FIG. 6(*d*). Reference numeral 4 denotes a driving shaft as a rotation axis of the driving scroll member 1. Reference numeral 5 denotes a follower shaft as a rotation axis of the follower scroll member 2, in which follower shaft 5 a discharging passage 5*a* for discharging the fluid in the fluid compressing chamber 3 is formed to perforate the follower shaft 5. The distance L between the shaft center $O_1$ of the driving scroll member 1 and the shaft center $O_2$ of the follower scroll member 2 is set to L=P/2–t, where reference letter P denotes the pitches of the fluid compressing walls 1*b* and 2*b* of the scroll members 1 and 2, and reference letter t denotes the thicknesses of the fluid compressing walls 1*b* and 2*b*. Reference numeral 6 denotes a housing for accommodating the whole apparatus. Reference numeral 7 denotes a thrust bearing for supporting the other surface 1*ab* side of the disc 1*a*. Reference numeral 8 denotes a lower bearing supporter fixed to the housing 6 for supporting the thrust bearing 7 and provided with bearings 9*a* and 9*b* supporting the driving shaft 4. Reference numeral 10 denotes a thrust bearing for supporting the other surface 2*ab* side of the disc 2*a*. Reference numeral 11 denotes an upper bearing supporter for supporting the thrust bearing 10.

The upper bearing supporter 11 is provided with a bearing 12 and a bearing 13 for supporting the follower shaft 5 at two points on the surface 2*ab* side of the disc 2*a*. Reference numeral 14 denotes a supporter fixed to the housing 6 for supporting the upper bearing supporter 11 with a bolt 15.

Reference numeral 16 denotes an electric motor which is a driving source of the disc 1*a*, and which is composed of a stator coil 17, a stator core 18 mounting the stator coil 17 and a rotor 19 fixed to the driving shaft 4, and further which is held by an electric motor holding part 20.

Reference numeral 21 denotes an oil reservoir provided at the top portion of the upper shaft supporter 11. Reference numeral 22 denotes an end plate attached to the top portion of the oil reservoir 21 with the bolt 23. Reference numeral 24 denotes a rotating mechanical seal attached to the shaft end of the follower shaft 5. Reference numeral 25 denotes a fixed mechanical seal attached to the end plate 22 and touching the mechanical seal 24 for preventing the leakage of compressed fluid. Reference numerals 26*a*–26*e* denote a sealing member for preventing the leakage of compressed fluid, which sealing member 26*a*–26*e* is inlaid into a slot (not shown) for sealing formed at the top of the fluid compressing wall 1*b*. Reference numerals 27*a*–27*e* denote a sealing member for preventing the leakage of compressed fluid, which sealing member 27*a*–27*e* is set in a slot (not shown) for sealing formed at the top of the fluid compressing wall 2*b*.

Reference numeral 28 denotes an oil pump to be driven by the driving shaft 4. Reference numeral 29 denotes an oil filler pipe for feeding lubricating oil from the oil pump 28 into the oil reservoir 21. Reference numeral 30 denotes an introducing passage attached to the housing 6 for introducing fluid into the fluid compressing chamber 3 from the outside. Reference numeral 31 denotes lubricating oil accumulated in the bottom of the housing 6.

Next, the principle of the operation of the conventional pump will be described.

When the electric motor 16 is rotated, the driving scroll member 1 is rotated around the shaft center $O_1$. Since the shaft center $O_1$ of the driving scroll member 1 is parted from the center $O_2$ of the follower scroll member 2 by the distance L, as shown in FIG. 6(*a*), sealing portions $S_1$–$S_6$ in a radial direction of the fluid compressing walls 1*b* and 2*b* are formed in a state of a straight line in the tangential direction on involute basic circle (not shown).

As shown in FIG. 6(*b*), the external periphery side of the fluid compressing wall 2*b* touches the internal periphery side of the fluid compressing wall 1*b* at sealing portions $A_1$–$A_3$ on the left side of the shaft center $O_2$. Since the internal periphery side of the fluid compressing wall 1*b* moves so as to decrease its diameter when it is seen from the shaft center $O_1$ owing to the sealing portion $A_1$–$A_3$, the internal periphery side inevitably touches the external periphery side of the fluid compressing wall 2*b* to drive the follower scroll member 2 to rotate.

In a state that the driving scroll member 1 and the follower scroll member 2 are performing the compressing movement together. Since the driving scroll member 1 is rotated by the electric motor 16 and the follower scroll member 2 receives only the compressing torque, the follower scroll member 2 tends to rotate around the shaft center $O_2$ in a direction contrary to the driving scroll member 1. In this case, the follower scroll member 2 touches the driving scroll member 1 at the sealing portions $B_1$–$B_3$ shown in FIG. 6(*b*), and the contrary rotation of the follower scroll member 3 is prevented by the sealing portions $B_1$–$B_3$ to continue the compressing movement.

Besides, when the driving scroll member 1 begins to decreasing its speed for stopping or the like, the follower scroll member 2 tends to rotate fast owing to the inertia of the movement thereof, but as shown in FIG. 6(*b*), since the scroll members 1 and 2 touches each other at the sealing portions $B_1$–$B_3$ on the right side of the shaft center $O_1$, they rotate synchronously. This rotation is performed in the order of: FIG. 6(*a*)→FIG. 6(*b*)→Fig. 6(*c*)→FIG. 6(*d*)→FIG. 6(*a*).

On the other hand, by the rotation of the driving shaft 4, the oil pump 28 is actuated to send the lubricating oil 31 to the oil reservoir 21 through the oil filler pipe 29 for lubricating the rotating mechanical seal 24 and the fixed mechanical seal 25. After the lubricating oil 31 lubricated the thrust bearing 7, the bearings 9*a*, 9*b*, the thrust bearing 10, the bearing 12 and the bearing 13, the lubricating oil 31 is returned to the inside bottom of the housing 6.

By taking the construction as described above, each of the driving shaft 4 and the follower shaft 5 is prevented from being seized by the rocking of both the scroll members 1 and 2.

Since the relative motion of the driving scroll member 1 and the follower scroll member 2 as shown in FIG. 6(*a*)–FIG. 6(*d*) can be fluently operated by providing the oil reservoir 21, the fluid compressing chamber 3 gradually moves from the external periphery side to the center side, and the volume of the chamber 3 gradually decreases. Consequently, the pressure for compressing the fluid introduced from the introducing passage 30 can gradually be increased, thereby the fluid can be pressed to be discharged from the discharging passage 5*a* as a high pressure gas.

The conventional scroll type pump as described above is constructed so that the bearings 12 and 13 for supporting the follower scroll member 2 are disposed only on the one side of the center of gravity 2*c* of the follower scroll member 2, it is difficult to support the follower scroll member 2 in a balanced state, and consequently rocking of the follower scroll member 2 is generated.

Moreover, since a force is generated on the thrust bearings 7 and 10 as a reaction force to the compressing force of the fluid, an over load is imposed on the sealing portions $S_1$–$S_6$ of the driving scroll member 1 and the follower scroll member 2.

Accordingly, for preventing the abrasion of the sealing portions $S_1$–$S_6$ of the driving scroll member 1 and the follower scroll member 2 where the over load is imposed, the lubricating oil 31 lubricating the bearings 12 and 13 is indispensable. If the conventional pump is used in an oil-free state not using the lubricating oil, the abrasion becomes remarkable, and consequently, there are problems that the early abrasion of the scroll members 1 and 2 and noises are generated, and that there is a case that the scroll members 1 and 2 are seized to be locked in the worst case.

SUMMARY OF THE INVENTION

In view of the foregoing, it is an object of the present invention to provide a scroll type pump which can suppress the rocking of the follower scroll member thereof and which can prevent the abrasion of a limited part of the follower scroll member, and further which can be used in an oil-free state.

It is another object of the present invention to provide a scroll type pump which is superior in space utility, workability and strength.

It is a further object of the present invention to provide a scroll type pump which can suppress the rocking of the follower scroll member thereof by means of a small force, and which can employ a bearing large in size and superior in strength, and further the follower scroll member of which rotate stably.

According to the first aspect of the present invention, for achieving the above-mentioned objects, there is provided a scroll type pump comprising a driving scroll member composed of a first disc and a spiral first fluid compressing wall provided on a one side surface of the first disc, a follower scroll member composed of a second disc and a spiral second fluid compressing wall provided on a one side surface of the second disc to engage with the first fluid compressing member, which follower scroll member is driven by the driving scroll member to rotate, a first bearing mounting part extending from the second disc to a predetermined position located on a side of an end of the spiral second fluid compressing wall with respect to a center of gravity of the follower scroll member, a first bearing mounted in the first bearing mounting part, a second bearing mounting part extending from the second disc to a position which is opposed to the first bearing mounting part, with the center of gravity of the follower scroll member being between the first and second bearing mounting parts, a second bearing mounted in the second bearing mounting part, and a supporting part for supporting rotation of the follower scroll member, which supporting part is fitted to the first and the second bearings respectively and is fixed to a housing.

As stated above, the scroll type pump according to the first aspect of the present invention supports the follower scroll member with the first bearing and the second bearing so as to locate the center of gravity of the follower scroll member between them, and consequently, even if the weight distributed in each part of the follower scroll member is different from each other, by providing the first and the second bearings to locate the center of gravity between them, the rocking of the follower scroll member caused by the deviation of the first and the second bearings from the center of gravity can be suppressed, and the second disc can be rotate stably and vertically to the supporting member thereof to be able to suppress the rocking of the follower scroll member.

According to the second aspect of the present invention, there is provided a scroll type pump wherein the center of gravity of a follower scroll member locates at a position between an upper end portion of a first bearing and a lower end portion of a second bearing.

As stated above, in the scroll type pump according to the second aspect of the present invention, the center of gravity of the follower scroll member locates at a position between the upper end portion of the first bearing and the lower end portion of the second bearing, and consequently, the pump can suppress rocking torque generated by the rocking of the follower scroll member to be small.

According to the third aspect of the present invention, there is provided a scroll type pump wherein at least one of a first bearing and a second bearing is a needle bearing.

As stated above, in the scroll type pump according to the third aspect of the present invention, at least one of the first bearing and the second bearing is constructed with a needle bearing, and consequently, there can be obtained a scroll type pump which is superior in space utility, workability and strength.

According to the fourth aspect of the present invention, there is provided a scroll type pump wherein a first bearing mounting part is provided at a lower end of a supporting part for supporting the rotation of a follower scroll member.

As stated above, the scroll type pump according to the fourth aspect of the present invention wherein the first bearing mounting part is provided at the lower end of the supporting part for supporting the rotation of the follower scroll member, and consequently, the pump can provide a first and a second bearings so as to put the center of gravity of the follower scroll member between them to realize the rotation of the follower scroll member with almost no rocking.

According to the fifth aspect of the present invention, there is provided a scroll type pump comprising a follower scroll supporting member one end of which is supported in a state of touching a first bearing and the other end of which is connected to an edge portion of a second disc, and which follower scroll supporting member has a communicating hole for passing fluid to be introduced into the follower scroll supporting member.

As stated above, since the scroll type pump according to the fifth aspect of the present invention can set the position for mounting a first bearing at a position distant from the center of gravity by being provided with the follower scroll supporting member, the rocking torque generated around the center of gravity can be reduced at the position of the first bearing so that the rocking of the follower scroll member can be suppressed by means of a small force. Moreover, since a large bearing having high strength can be employed as the first bearing for the diameter of which can be set large, the rotation of the follower scroll member can be stabilized.

BRIEF DESCRIPTION OF THE DRAWINGS

Further objects and advantages of the present invention can be more fully understood from the following detailed description taken in conjunction with the accompanying drawings, in which:

FIG. 3(*a*)–FIG. 3(*d*) are sectional views showing the operation of the principal part of the scroll type pump shown in FIG. 1;

DETAILED DESCRIPTION OF THE PREFERRED EMBODIMENTS

Preferred embodiments of the present invention will now be described in detail with reference to the accompanying drawings.

Embodiment 1

Figure 1:
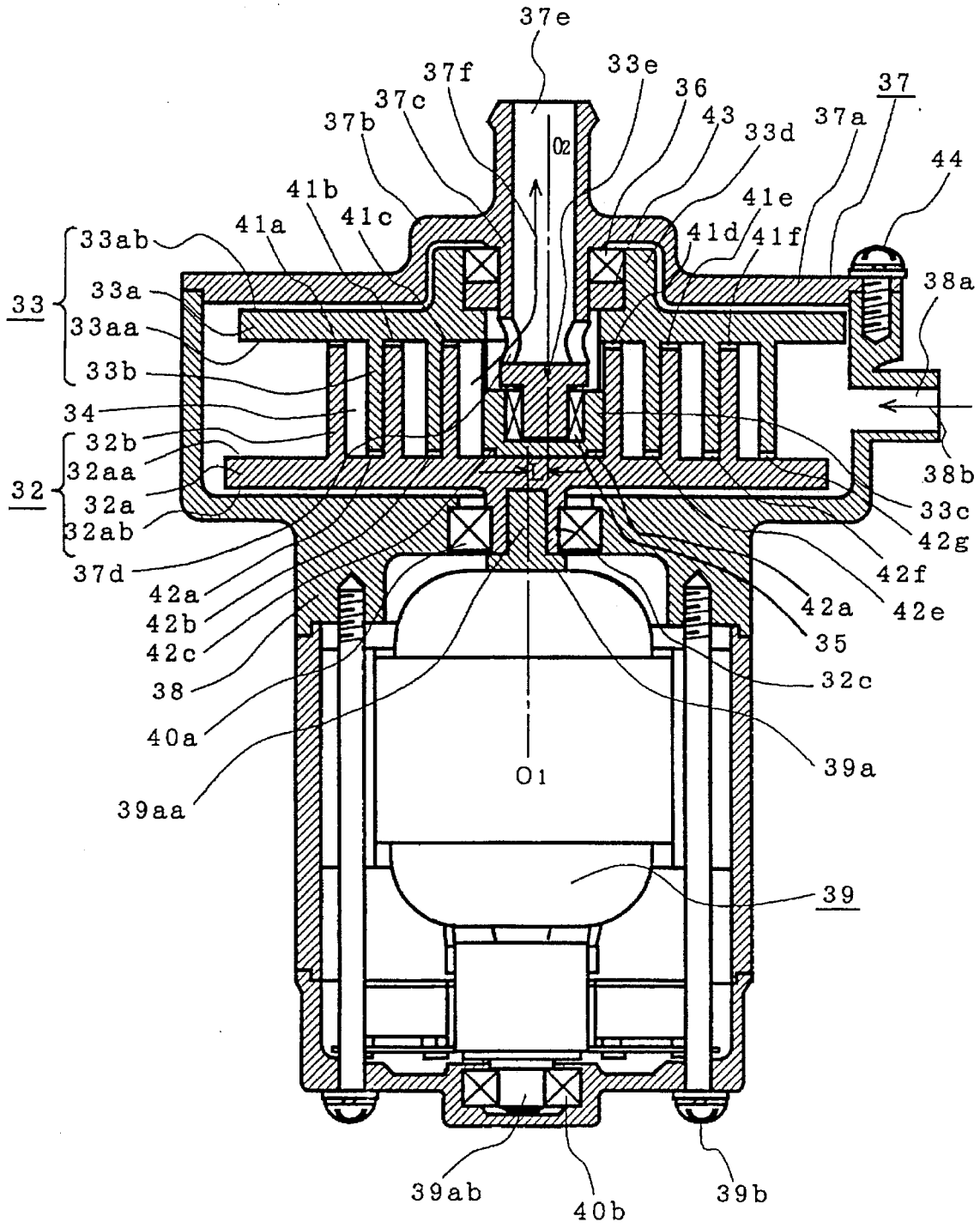
FIG. 1 is a cross sectional view showing the scroll type pump of an embodiment of the present invention.
Figure 2:
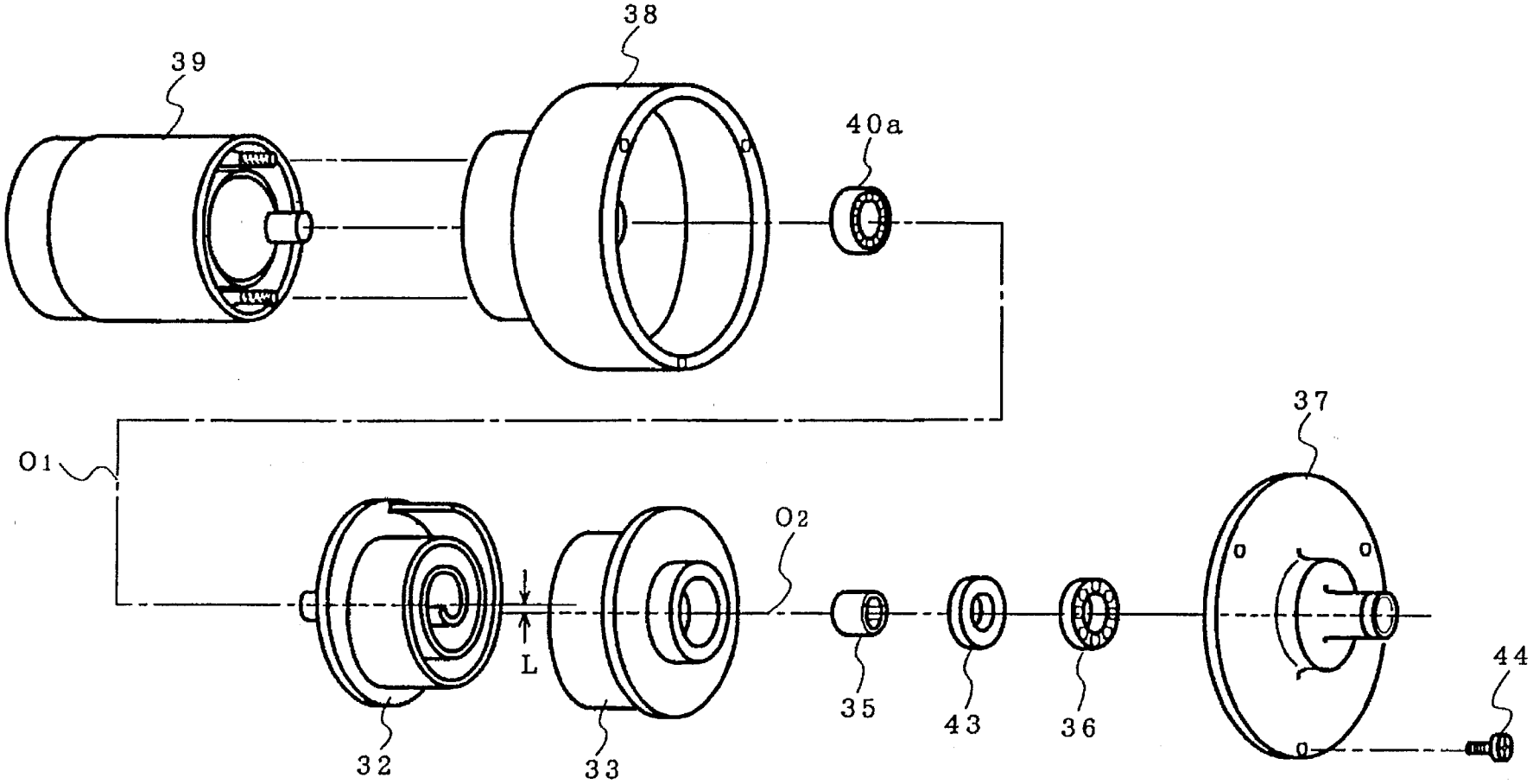
FIG. 2 is an exploded perspective view of the scroll type pump shown in FIG. 1.

FIG. 1 is a cross sectional view showing the scroll type pump of an embodiment of the present invention. FIG. 2 is an exploded perspective view of the scroll type pump shown in FIG. 1. FIG. 3(*a*)–FIG. 3(*d*) are sectional views showing the principal part of the scroll type pump shown in FIG. 1.

In FIG. 1 and FIG. 2, reference numeral 32 denotes a driving scroll member composed of a first disc 32*a* provided with a first fluid compressing wall 32*b* formed in a spiral shape as shown in FIG. 3(*a*)–FIG. 3(*d*) on the one side surface 32*aa* of a first disc 32*a*, and a driving shaft disposing part 32*c* for disposing a driving shaft 39*a* at the center part of the other surface 32*ab* of the first disc 32*a*. Reference numeral 33 denotes a follower scroll member composed of a second disc 33*a* provided with a second fluid compressing wall 33*b* formed in a spiral shape as shown in FIG. 3(*a*)–FIG. 3(*d*) on the one side surface 33*aa* of the second disc 33*a* for being driven to rotate by the driving scroll member 32.

The follower scroll member 33 is provided with a first bearing mounting part 33*c* extending from the second disc 33*a* to a predetermined position located on a side of the end of the second fluid compressing wall 33*b* with respect to the center of gravity 33*e* of the follower scroll member 33, and a second bearing mounting part 33*d* extending from the second disc 33*a* to a position opposing to the first bearing mounting part 33*c*, with the center of gravity 33*e* of the follower scroll member 33 being located between the first bearing mounting part 33*c* and the second bearing mounting part 33*d*. In the present embodiment, the first bearing mounting part 33*c* is disposed on the first disc 32*a* side with respect to the center of gravity 33*e*, and the second bearing mounting part 33*d* is disposed on the second disc 33*a* side with respect to the center of gravity 33*e*.

Reference numeral 34 denotes a fluid compressing chamber shaped generally as a crescent with the first fluid compressing wall 32*b* and the second fluid compressing wall 33*b* as shown in FIG. 3(*a*)–FIG. 3(*d*). The center of the rotation axis of the driving scroll member 32 is denoted by a reference letter $O_1$, and the center of the rotation axis of the follower scroll member 32 is denoted by a reference letter $O_2$. The distance between the centers $O_1$ and $O_2$ of the rotation axes is denoted by a reference letter L.

Reference numeral 37 denotes a casing composed of an end plate 37*a* parallel to the surface 33*ab* of the second disc 33*a*, an accommodating part 37*b* for accommodating the second bearing mounting part 33*d* therein, and a supporting part 37*c* fitted to each of the first bearing 35 and the second bearing 36 for supporting the rotation of the follower scroll member 33. At a portion of the external periphery of the supporting part 37*c*, there are formed a communicating hole 37*d* for communicating the fluid in the fluid compressing chamber 34 into a discharging passage 37*e* and the discharging passage 37*e* for discharging the compressed fluid to the outside.

Reference numeral 38 denotes a housing for accommodating the driving scroll member 32 and the follower scroll member 33 in a closed space formed by the housing 38 and the casing 37. An introducing passage 38*a* for introducing fluid from the outside is formed at a part of the housing 38. Reference numeral 39 denotes an electric motor which is a driving source to drive to rotate the driving scroll member 32, and which is provided with a driving shaft 39*a* the one end 39*aa* of which is disposed in the driving shaft disposing part 32*c* and a bolt 39*b* for fixing the electric motor 39 to the housing 38.

Reference numeral 40*a* denotes a bearing fitted to the external peripheral surface of the driving shaft disposing part 32*c* for supporting the driving scroll member 32 rotatably. Reference numeral 40*b* denotes a bearing for supporting the other end 39*ab* of the driving shaft 39*a*. Reference numerals 41*a*–41*f* denote a sealing member for preventing the leakage of compressed fluid, which sealing member 41*a*–41*f* is inlaid into a slot (not shown) for sealing formed at the end of the fluid compressing wall 32*b*. Reference numerals 42*a*–42*g* denote a sealing member for preventing the leakage of compressed fluid, which sealing member 42*a*–42*g* is set in a slot (not shown) for sealing formed at the end of the fluid compressing wall 33*b*.

Reference numeral 43 denotes a rotating mechanical seal attached to the second bearing 36 for preventing the leakage of the fluid in the fluid compressing chamber 34. Reference numeral 44 denotes a bolt for fixing the casing 37 to the housing 38.

Next, the operation thereof will be described. Since the operation principles of the driving scroll member 32 and the follower scroll member 33 are the same as those of the conventional ones, the description about them will be omitted.

As shown in FIG. 3(*a*)–FIG. 3(*d*), the processes of the rotation of the driving scroll member 32 and the follower scroll member 33 are in the order of: FIG. 3(*a*) (rotation angle: 0°)→FIG. 3(*b*) (rotation angle: 90°)→FIG. 3(*c*) (rotation angle: 180°)→FIG. 3(*d*) (rotation angle: 270°) →FIG. 3(*a*) (rotation angle: 360°). As for the flow of fluid, in FIG. 1, at first fluid is introduced through the introducing passage 38*a* from the outside (in the direction of an arrow 38*b*) to be gradually compressed toward the internal peripheral side of the fluid compressing chamber 34 from the external peripheral side thereof. The compressed fluid is sent out to the discharging passage 37*e* through the communicating hole 37*d* for being discharged to the outside (in the direction of an arrow 37*f*).

FIG. 3(*a*)–FIG. 3(*d*) shows the scroll type pump which has one spirally shaped fluid compressing wall to each scroll member 32 and 33 respectively, but two or more fluid compressing walls can be provided to each scroll member 32 and 33.

Since in the scroll type pump constructed as described above the follower scroll member 33 is supported with the first bearing 35 and the second bearing 36 so that the center of gravity 33*e* of the follower scroll member 33 is located between them, the rocking of the follower scroll member 33 can be suppressed. Accordingly, even if the weight distributed in each part of the follower scroll member 33 is different from each other, by providing the first and the second bearings 35 and 36 to located the center of gravity 33*e* between them, the rocking of the follower scroll member 33 caused by the deviation of the first and the second bearings 35 and 36 from the center of gravity 33*e* can be suppressed, and then the second disc 33*b* can rotate stably and vertically to the supporting part 37*c*.

Therefore, the abrasion of the sealing portions $S_1$–$S_5$, shown in FIG. 3(*a*), of the first fluid compressing wall 32*b* and the second fluid compressing wall 33*b* can be suppressed, and the reliability of the apparatus is consequently improved.

Moreover, since the rocking of the follower scroll member is suppressed, the seizure and the locking of the follower scroll member 33 which are caused by the rocking thereof are suppressed, and the scroll type pump can consequently be used as an oil-free dry system.

If the first bearing 35 is constructed by a needle bearing and the second bearing 36 is constructed by a ball bearing, there can be obtained a scroll type pump which is superior in space utility especially owing to the needle bearing, and superior in workability and strength, and which can prevent rocking.

Embodiment 2

Figure 4:
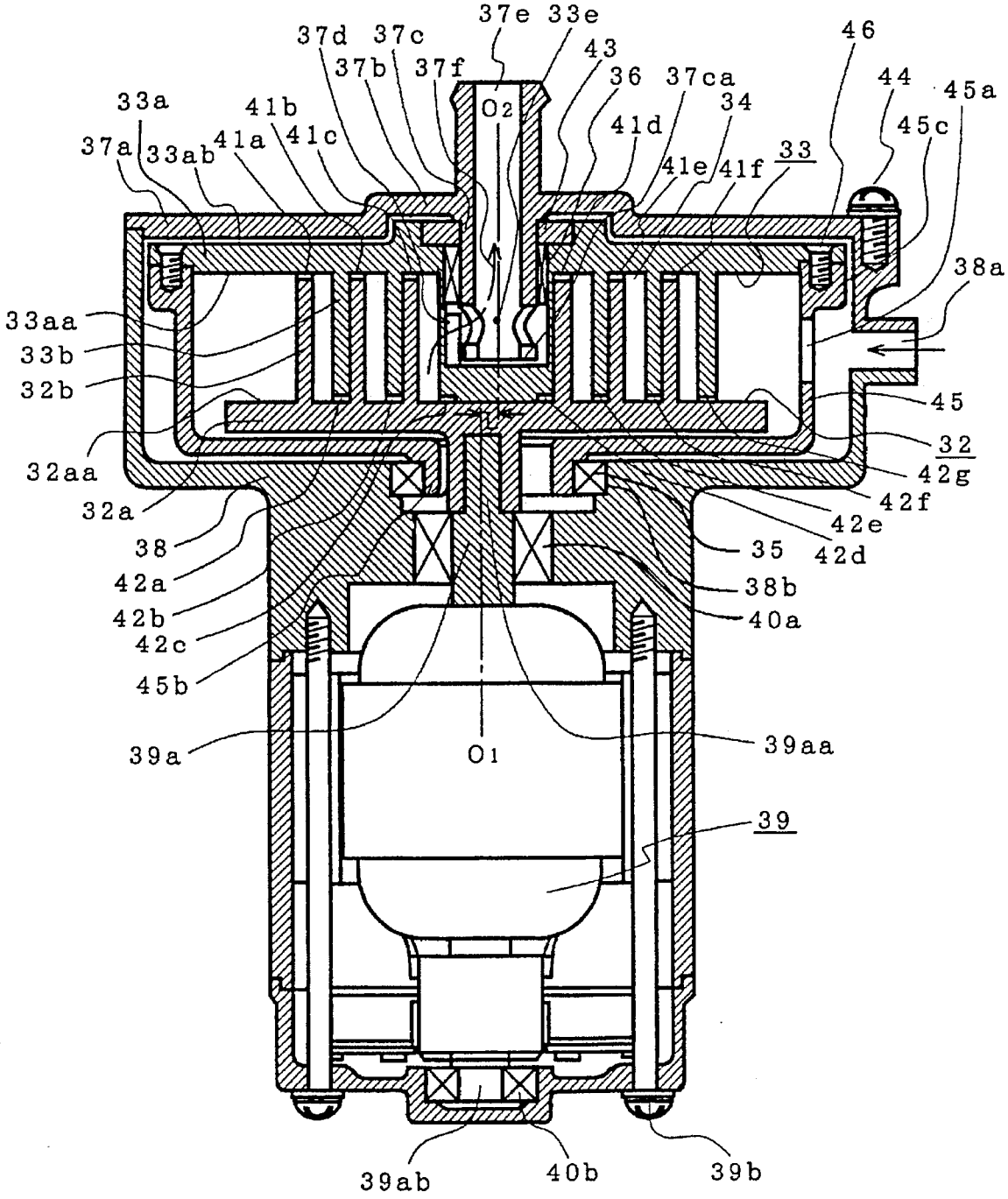
FIG. 4 is a cross sectional view showing the scroll type pump of another embodiment of the present invention.
Figure 5:
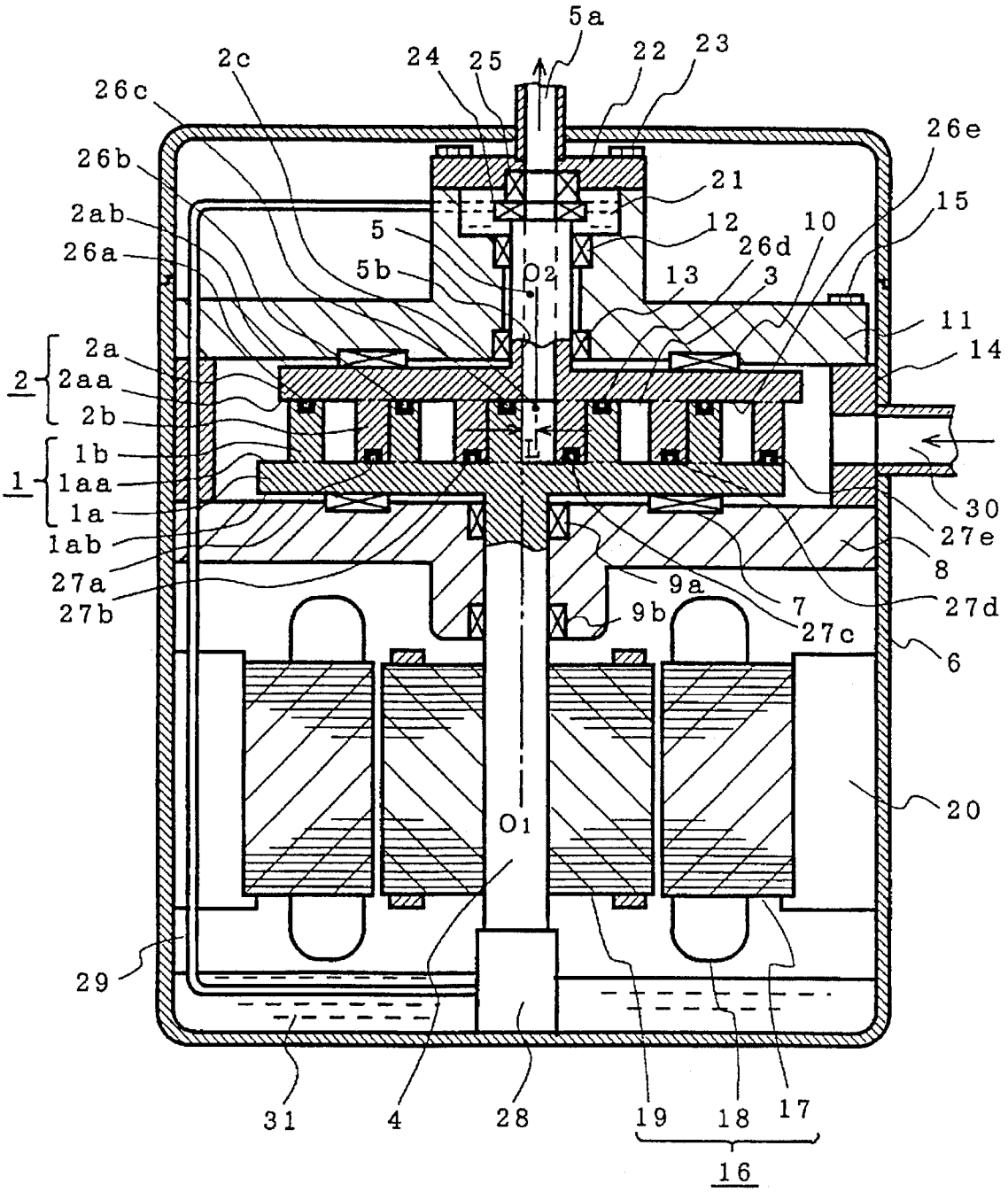
FIG. 5 (PRIOR ART)
FIG. 5 is a cross sectional view showing a conventional scroll type pump.
Figure 6:
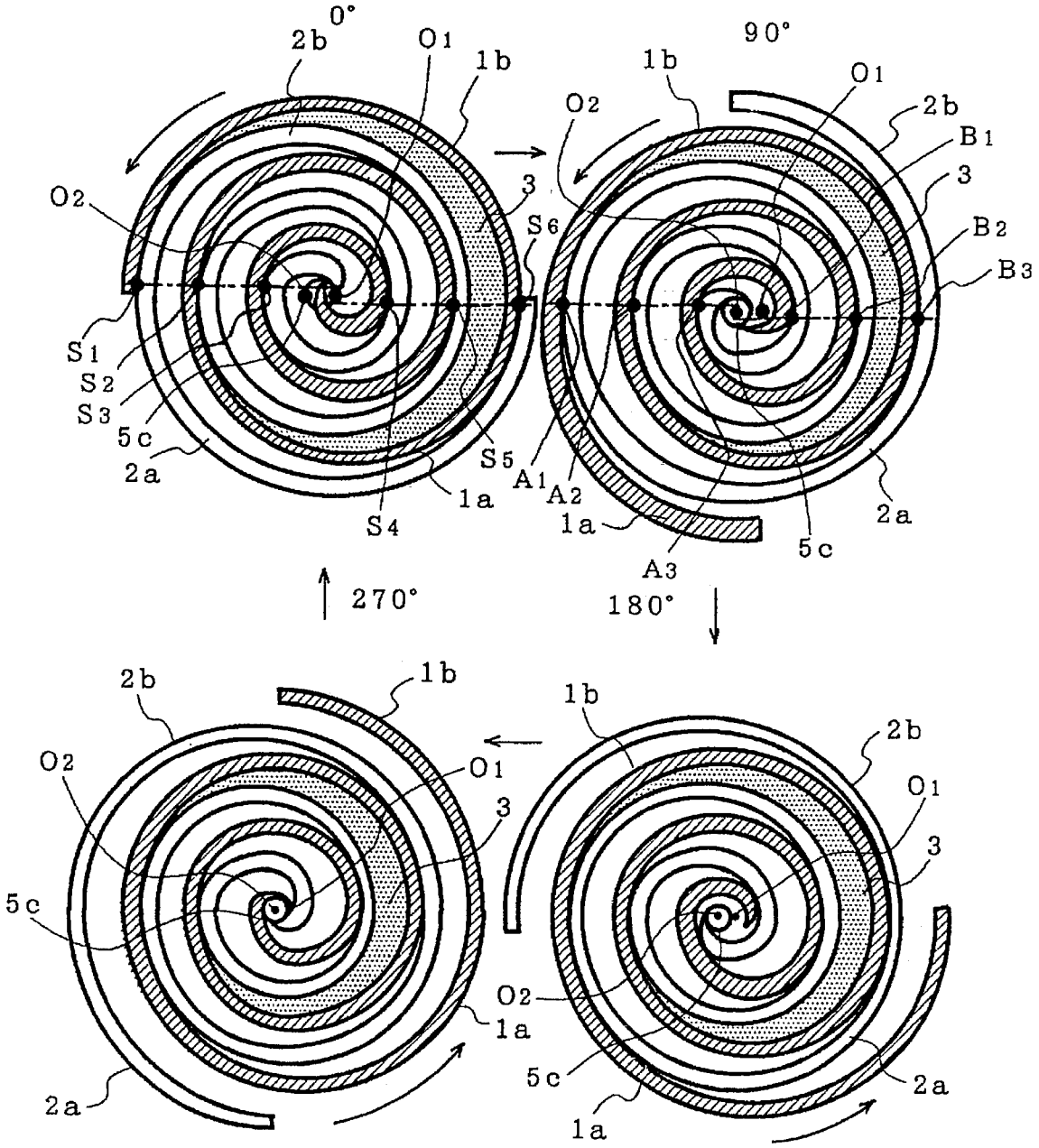
FIG. 6 (a) (PRIOR ART)
FIG. 6 (b) (PRIOR ART)
FIG. 6 (d) (PRIOR ART)
FIG. 6 (c) (PRIOR ART)
FIG. 6(*a*)–FIG. 6(*d*) are sectional views showing the operation of the principal part of the conventional scroll type pump shown in FIG. 5.

In the embodiment 1 described above, the first and the second bearings 35 and 36 are constructed to touch the follower scroll member 33 directly, but they may also be constructed as shown in FIG. 4. In the present embodiment shown in FIG. 4, the housing 38 is provided with a boss part 38*b*, and the center axis of which is the same as the shaft center $O_2$ of the supporting part 37*c*, and further the first bearing 35 is disposed in the boss part 38*b*. Besides the embodiment is provided with a follower scroll supporter 45, one end 45*b* of which constitutes a first bearing mounting part and is supported in a state of touching the first bearing 35, and the other end 45*c* of which is connected to the edge portion of the second disc 33*a*. And further, the follower scroll supporter 45 has a communicating hole 45*a* for communicating the fluid to be introduced from the introducing passage 38*a* into the fluid compressing chamber 34.

The embodiment 2 is constructed as described above, and operates similarly to the embodiment 1, and further carries the advantages identical to those of the embodiment 1. In addition, since the position for mounting the first bearing 35 can be set at a position more distant than that of the embodiment 1 from the center of gravity 33*e* by providing the follower scroll supporter 45, the rocking torque generated around the center of gravity 33*e* can be reduced more than that of the embodiment 1 at the position of the first bearing 35. Consequently, the rocking of the follower scroll member 33 can be suppressed by means of a small force. Moreover, since a large bearing having high strength can be employed as the first bearing 35 for the diameter of which can be taken large, the rotation of the follower scroll member 33 can be stabilized.

If the first bearing 35 of the embodiment 2 is constructed by a needle bearing and the second bearing 36 thereof is constructed by a ball bearing, there can be obtained a scroll type pump which is superior in space utility especially owing to the needle bearing, and superior in workability and strength.

As for the center of gravity 33*e* of the follower scroll member 33 in the scroll type pumps according to the embodiments 1 and 2 of the present invention, it is preferable that the center of gravity 33*e* exist at a position almost halfway between the first bearing 35 and the second bearing 36, but so long as it exists at a position between the upper end of the first bearing 35 and the lower end of the second bearing 36, the generation of rocking torque can be suppressed to be small.

In the aforementioned embodiments, the spiral fluid compressing walls 32*b* and 33*b* are provided to each scroll member by one sheet, but a construction having two or more fluid compressing walls to each scroll member respectively can bring similar advantages.

As described above, the present invention can suppress the rocking of the follower scroll member by providing the first bearing and the second bearing so as to put the center of gravity of the follower scroll member between them, and thereby, the invention carries an advantage that the abrasion of the sliding surface of the driving scroll member and the follower scroll member can be prevented.

While preferred embodiments of the present invention have been described by means of specific terms, such description is for illustrative purposes only, and it is to be understood that changes and variations may be made without departing from the spirit or scope of the following claims.

What is claimed is:

1. A scroll type pump comprising:

a housing, a driving scroll member disposed in said housing and composed of a first disc and a spiral first fluid compressing wall provided on one side surface of the first disc, a follower scroll member disposed in said housing and composed of a second disc and a spiral second fluid compressing wall provided on one side surface of the second disc to engage with said first fluid compressing wall, said spiral second fluid compressing wall defining an end spaced apart from the one side surface of the second disc, said follower scroll member being driven by said driving scroll member to rotate, a first bearing mounting part extending from said second disc to a predetermined position located on a side of said end of said spiral second fluid compressing wall with respect to a center of gravity of said follower scroll member, a first bearing mounted with respect to said first bearing mounting part, a second bearing mounting part extending from said second disc to a position which is opposed to said first bearing mounting part, with said center of gravity of said follower scroll member being located between said first bearing mounting part and said second bearing mounting part, a second bearing mounted in said second bearing mounting part, and a supporting part for supporting rotation of said follower scroll member, said supporting part being fitted to at least said second bearing and being fixed to said housing.

2. A scroll type pump according to claim 1, wherein at least one of said first bearing and said second bearing is a needle bearing.

3. A scroll type pump according to claim 1, wherein said first bearing mounting part is provided at a lower end of said supporting part for supporting rotation of said follower scroll member.

4. A scroll type pump according to claim 1, further comprising a follower scroll supporting member, one end of which constitutes said first bearing mounting part and is in contact with said first bearing so as to be rotatably supported, and another end of which is connected to an edge portion of said second disc, said follower scroll supporting member having a communicating hole for passing fluid to be introduced into said follower scroll supporting member.

5. A scroll type pump according to claim 1, wherein said center of gravity of said follower scroll member is located at a position between an upper end portion of said first bearing and a lower end portion of said second bearing.

6. A scroll type pump according to claim 5, wherein at least one of said first bearing and said second bearing is a needle bearing.

7. A scroll type pump according to claim 5, wherein said first bearing mounting part is provided at a lower end of said supporting part for supporting rotation of said follower scroll member.

8. A scroll type pump according to claim 5, further comprising a follower scroll supporting member, one end of which constitutes said first bearing mounting part and is in contact with said first bearing so as to be rotatably supported, and another end of which is connected to an edge portion of said second disc, said follower scroll supporting member having a communicating hole for passing fluid to be introduced into said follower scroll supporting member.

* * * * *